United States Patent [19]

Cunningham et al.

[11] Patent Number: 4,739,596

[45] Date of Patent: Apr. 26, 1988

[54] ANCHOR PLATE FOR PLUMBING CONDUIT

[76] Inventors: Carol Cunningham; Jan C. Steinert, both of 6N460 Ferson Woods Dr., St. Charles, Ill. 60174

[21] Appl. No.: 946,920

[22] Filed: Dec. 29, 1986

[51] Int. Cl.[4] ..... E04B 5/48

[52] U.S. Cl. ..... 52/221; 248/56; 248/57

[58] Field of Search ..... 52/221, 34; 248/56, 248/57; 285/42, 46, 64; 138/106

[56] References Cited

U.S. PATENT DOCUMENTS

| | | | |
|---|---|---|---|
| 713,537 | 11/1902 | Treadwell | 248/57 X |
| 814,295 | 3/1906 | Kelly | 248/57 |
| 1,278,895 | 9/1918 | Fauley | 285/46 X |
| 2,463,405 | 3/1949 | McMaster | 285/64 |
| 3,034,185 | 5/1962 | Olsen | 248/56 X |
| 3,365,152 | 1/1968 | Blunk | 248/56 |
| 3,366,356 | 1/1968 | Fisher | 248/56 |
| 3,684,220 | 8/1972 | Logsdon | 248/56 |
| 3,809,350 | 5/1974 | Lane | 138/106 X |
| 4,490,954 | 1/1985 | Cresti | 52/221 |
| 4,516,749 | 5/1985 | Sullivan | 248/56 |

*Primary Examiner*—Carl D. Friedman

*Attorney, Agent, or Firm*—Hill, Van Santen, Steadman & Simpson

[57] ABSTRACT

An anchor plate for locking a plumbing conduit extending through a wall opening into firm assembly with the wall is a generally U-shaped plate that fits over the plumbing conduit and is soldered thereto. The anchor plate includes holes through which fastening screws extend into the wall. The lateral extent of the plate is no greater than a decorative wall escutcheon so that the plate is hidden behind the escutcheon.

8 Claims, 1 Drawing Sheet

ANCHOR PLATE FOR PLUMBING CONDUIT

BACKGROUND OF THE INVENTION

1. Field of the Invention

The present invention relates generally to a plumbing conduit anchor and, more particularly, to an anchor plate for stabilizing a plumbing conduit or tubing or pipe extending through a wall opening.

2. Description of the Prior Art

When plumbing tubing or piping is installed extending through a wall, such as a dry wall, openings are cut in the wall through which tubing or conduit portions extend. The openings are generally larger than the conduit portions. These conduit portions generally connect inside the wall to transversely extending conduits, and a plurality of such conduit portions are frequently connected to a single transversely extending conduit. Various plumbing fixtures are affixed at the end of the conduit portions outside the wall.

During use of the plumbing fixtures that are connected to the tubing, flexing of the transverse tubing occurs because such tubing is most frequently constituted by thin wall copper tubing which is inherently more flexible than a rigid pipe. Thus, movement occurs of the conduit or tubing portions through the wall openings. This is particularly true for flexible water supply pipes, which are frequently of flexible thin wall copper tubing. Such movement of the conduit portions not only gives the user the impression that the plumbing is faulty, but also leads to cracks and breaking in the surrounding wall area. When the words "tubing", "conduit", and/or ∓piping" are used herein, they will be used interchangeably insofar as meaning is concerned.

It is well known to provide wall escutcheons to cover the openings through which the conduit portions extend. The wall escutcheons are frequently decorative, such as by being chrome-plated.

SUMMARY OF THE PRESENT INVENTION

Plumbing conduit portions or tubing extending through openings in a wall are fixed relative to the wall by an anchor plate according to the principles of the present invention, wherein the anchor plate fits behind a wall escutcheon and is, thus, hidden from view. The present invention is embodied in an anchor plate having a generally U-shaped plate defining a bight or opening through which extends the conduit portion. The anchor plate snuggly embraces the conduit portion adjacent the wall surface and is secured to the wall by fasteners, such as expanding threaded fastening screws which extend through a plurality of bores in the anchor plate. The anchor plate is preferably affixed to the conduit portion, such as by soldering. The anchor plate is sized and shaped so that it is hidden from view behind the wall escutcheon when in use.

The present anchor plate is also advantageously used within a wall to steady a plumbing conduit, such as where the conduit extends through an opening in a wall stud.

Thus, a conduit portion or tubing extending through an opening is anchored securely by the present anchor plate to avoid movement of the conduit during use of plumbing fixtures connected thereto and to prevent the resulting cracking and crumbling of the wall adjacent the conduit portion. The anchor plate is simple and inexpensive to make and use and need not be provided with a decorative coating since it is hidden from view when in use.

DESCRIPTION OF THE PREFERRED EMBODIMENTS

Figure 1:
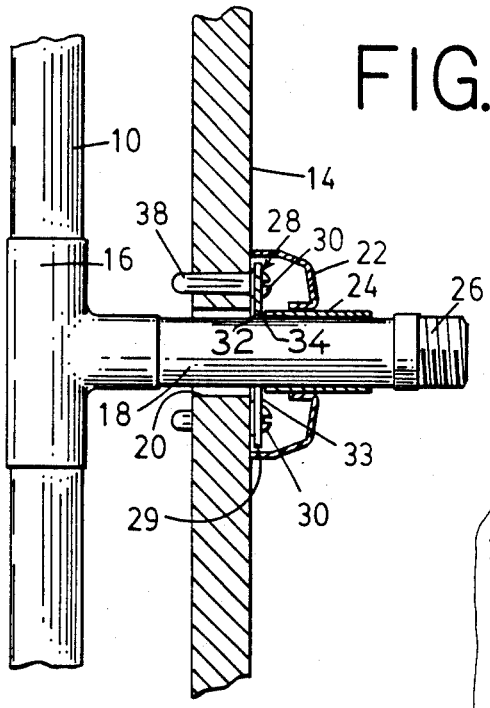
FIG. 1. vertical cross section through a building wall showing a plumbing conduit therein and a conduit portion extending through an opening in the wall and held by a conduit anchor according to the principles of the present invention.

In FIG. 1 is shown a plumbing conduit 10 within a wall 14 of a building. It should be understood that the conduit 10 could be a manifold connected to a source of supply and from which a plurality of headers or branches extend for connection to a corresponding plurality of utilitarian devices, for example, faucets, sinks, toilets, and other common plumbing fixtures which utilize water. Moreover, those headers or branches may be of different size, depending on the quantity of water to be delivered to the outlet. In the exemplary illustration of the drawings, the plumbing conduit 10 has a T-connection 16 along its length which provides a connection to the tubing comprising a short conduit portion or branch 18 that extends through an opening 20 in the wall panel 14. An escutcheon or fascia plate 22 is provided over the tubing or conduit portion 18 to provide a decorative cover over the wall opening 20. A chrome-plated sleeve 24 is provided about the conduit branch 18 so that the branch 18, which is usually of copper but may also be of galvanized metal or some rust resistant metal is more appealing to the eye. A fixture connection 26 to which a selected plumbing fixture is attached is threaded on an end of the conduit 18 opposite the T-connection 16. As noted, such plumbing fixtures can include faucets, showerheads, toilets, urinals, and the like.

In accordance with the present invention, the branch 18 is securely locked to the wall in firm assembly therewith by means of an anchor plate 28. The anchor plate 28 is generally circular in configuration, although conceivably other geometric shapes could be employed. In the illustrative embodiment of the present disclosure, the anchor plate 28 is provided with a circular circumferential edge 29 having a radius of such dimension that the edge 29 will be wholly confined within the interior of the escutcheon plate 22, i.e. the radius of curvature of the edge 29 is less than the radius of curvature of a wall engaging flange 23 on the escutcheon or fascia plate 22. The anchor plate 28 is disposed abutting the wall panel 14 and is designed to be firmly anchored to the wall and to the conduit. For example, fastening means such as a plurality of fastening screws 30 may be provided for fastening the anchor plate 28 to the wall 14. An anchor plate may also be provided on the conduit 10 within the wall where it extends through a wall stud (not shown).

Figure 2:
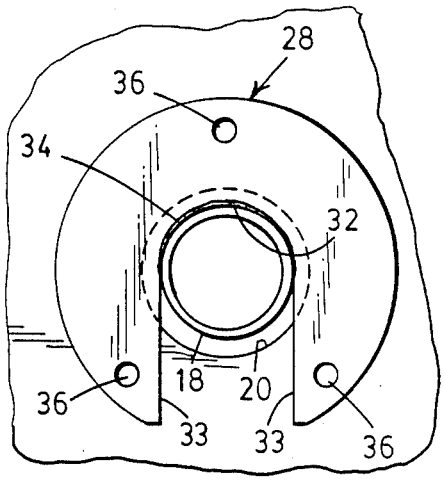
FIG. 2 is a plan view of the anchor plate of the present mounted on a plumbing conduit.

In FIG. 2, the anchor plate 28 of the present invention has a circular outline with a centrally disposed through opening 32. The opening 32 has generally parallel sides or legs 33 extending outwardly to form a bight opening out of one side of the anchor plate 28, thus giving the plate a "U" shape configuration. The anchor plate 28 is preferably firmly integrated to the conduit portion 18 at the central opening 34, for example, a soldered joint 34 is provided between the periphery of the pipe or conduit 18 and the inner edge of the opening 32. The anchor plate 28 extends outward from the conduit 18 and is considerably larger than the opening 20 in the wall 14 so that it overlies the adjacent wall area. In the illustrated embodiment, three openings or bores 36 extend through the anchor plate and are spaced equally about the central opening 32 through which the screws 30 pass for fastening the anchor plate 28 to the wall 14. Generally, the anchor plate 28 will accommodate all known standard pipes if made in several sizes. For example, the outer diameter of the edge 29 can be 2"or 2 ½". The size of the opening 32 can vary to fit pipes from ⅝" O.D. to 1 5/16" O.D., for example. The plate 28 may be conveniently formed from 1/32" copper plate stock or it can also be made from brass plate stock or some other suitable form of rigid material.

Figure 3:
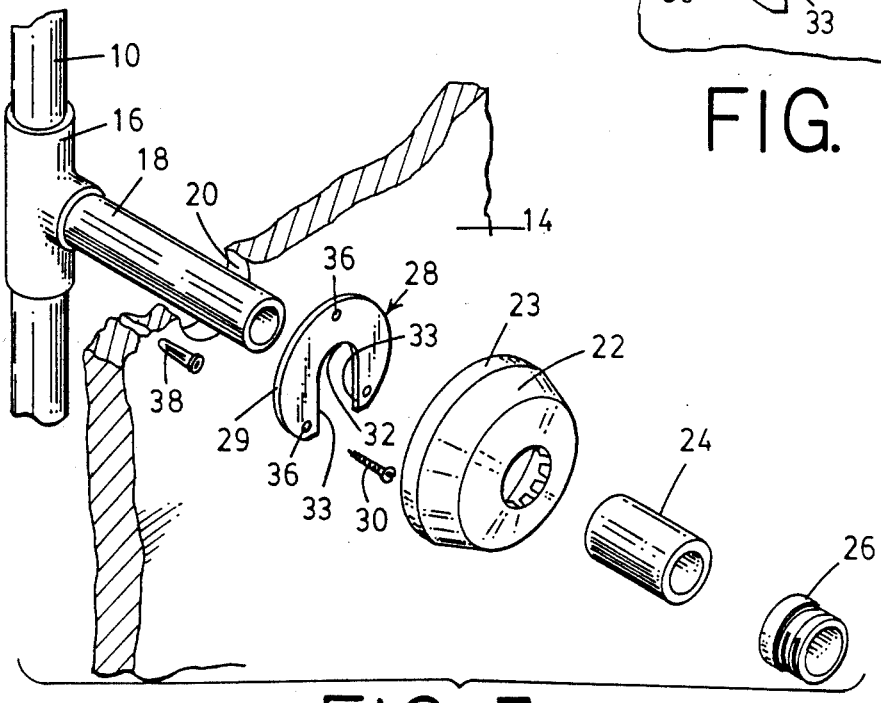
FIG. 3 is an exploded perspective view of a wall escutcheon and fixture connection and a plumbing conduit, including the anchor plate of the present invention.

With reference now to FIG. 3, the anchor plate 28 is shown for assembly between the conduit branch 18 that extends through the hole 20 and the wall 14. The anchor plate 28 is fastened to the wall 14 in firm assembly therewith by the threaded anchoring screw 30 which extends into expanding sleeves 38.

The anchor plate 28 is mounted on the tubing or conduit branch 18 either before or after the escutcheon 22, decorative pipe sleeve 24, and fixture mounting 26 are connected to the tubing or conduit 18. If the escutcheon 22 and the other parts have already been placed on the branch 18, the present anchor plate 28 may still be mounted thereon by moving the escutcheon 22 along the conduit 18 and mounting the anchor 28 on the conduit 18, since the bight 32 of the anchor 28 opens at the side of the anchor plate 28 and it may be slipped from the side over a conduit section 18. The anchor plate 28 may have an outline other than the circular outline shown, and is only limited by being wider than the opening 20 in the wall and sufficiently conformably smaller than the escutcheon 22 to be concealed thereby.

Although other modifications and changes may be suggested by those skilled in the art, it is the intention of the inventors to embody within the patent warranted hereon all changes and modifications as reasonably and properly come within the scope of their contribution to the art.

We claim as our invention:

1. An anchor for plumbing conduit extending through a wall surface, comprising:

a thin plate substantially U-shaped anchor member having a bright opening out of one side of said anchor member, said bight having a width substantially equal to a diameter of the plumbing conduit on which said anchor is to be used;

means to firmly integrate said anchor member to the plumbing conduit; and means for affixing said anchor member to said surface for placing said conduit in firm assembly with the wall.

2. An anchor for plumbing conduit extending through a wall surface, comprising:

a substantially U-shaped anchor member having a bight opening out of one side of said anchor member, said bight having a width substantially equal to a diameter of the plumbing conduit on which said anchor is to be used;

means affixing said anchor member to said surface and to said conduit for placing said conduit in firm assembly with the wall; and said anchor member being affixed to said plumbing conduit by a soldered joint.

3. An anchor for plumbing conduit extending through a wall surface, comprising:

a substantially U-shaped anchor member having a bight opening out of one side of said anchor member, said bight having a width substantially equal to a diameter of plumbing conduit on which said anchor is to be used;

means affixing said anchor member to said surface and to said conduit for placing said conduit in firm assembly with the wall; and said anchor member being substantially planar and formed of rigid metal material selected from the class of copper or brass material.

4. An anchor as claimed in claim 3, wherein said affixing means includes a plurality of through-extending holes in said anchor member, and means extending through said holes for affixing said anchor member to said surface.

5. An anchor as claimed in claim 3, wherein said anchor member is cut from sheet material made of metal material of the selected class.

6. An anchor plate for mounting behind an escutcheon at a wall for a plumbing conduit, comprising:

a planar substantially U-shaped anchor plate having a lateral extent less than that of the escutcheon behind which said anchor plate is mounted, said U-shaped anchor plate defining an opening at a side of said anchor plate, said opening having substantially parallel sides corresponding to an external diameter of the plumbing conduit;

means for mounting said anchor plate to the wall, including: a plurality of bores in said anchor plate, and threaded expanding anchors extending through said bores and into the wall; and means for connecting said anchor plate to the plumbing conduit including solder between the plumbing conduit and said anchor plate at said opening.

7. An anchor plate as claimed in claim 6, wherein said anchor plate is of a shape and size to be concealed by the escutcheon when the escutcheon is mounted over said anchor plate.

8. A conduit support for mounting behind a decorative wall escutcheon on a plumbing conduit, the plumbing conduit extending substantially perpendicular through an opening in a flat wall, comprising:

a thin plate having a lateral extent no greater than the decorative wall escutcheon so that the plate is hidden from view behind the escutcheon, said thin plate being substantially planar for planar engagement against the flat wall behind the escutcheon;

said thin plate defining a bight opening have a centrally disposed opening corresponding in size to the plumbing conduit and a channel from said central opening to an edge of said thin plate at least as wide as the plumbing conduit, said thin plate having a plurality of bores spaced substantially equally about said central opening; and threaded expanding anchors extending through each of said bores into the wall adjacent the opening, whereby said thin plate is mounted over the plumbing conduit at the wall to stabilize the conduit relative to the wall.

* * * * *